US008446235B2

(12) United States Patent
Iwamoto et al.

(10) Patent No.: US 8,446,235 B2
(45) Date of Patent: May 21, 2013

(54) ELECTROMAGNETIC RELAY AND METHOD OF MANUFACTURING THE SAME

(75) Inventors: Daiei Iwamoto, Tokyo (JP); Takashi Yuba, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/450,706

(22) Filed: Apr. 19, 2012

(65) Prior Publication Data

US 2012/0313737 A1 Dec. 13, 2012

(30) Foreign Application Priority Data

Jun. 7, 2011 (JP) ..... 2011-127740
Jun. 7, 2011 (JP) ..... 2011-127741
Jun. 7, 2011 (JP) ..... 2011-127742

(51) Int. Cl.
*H01H 51/22* (2006.01)
*H01H 9/30* (2006.01)

(52) U.S. Cl. ..... 335/78; 335/201

(58) Field of Classification Search ..... 335/78, 335/83, 201
See application file for complete search history.

(56) References Cited

U.S. PATENT DOCUMENTS

| | | | | |
|---|---|---|---|---|
| 2,875,303 | A * | 2/1959 | Immel et al. | 218/26 |
| 2,875,304 | A * | 2/1959 | White | 218/26 |
| 4,367,448 | A * | 1/1983 | Nishizako | 335/201 |
| 4,451,718 | A * | 5/1984 | Yamagata et al. | 218/23 |
| 4,546,336 | A * | 10/1985 | Petrie et al. | 335/16 |
| 5,109,146 | A | 4/1992 | Maenishi | |
| 5,546,061 | A * | 8/1996 | Okabayashi et al. | 335/78 |
| 7,285,742 | B2 * | 10/2007 | Kinzler et al. | 218/34 |
| 7,417,520 | B2 * | 8/2008 | Kralik | 335/201 |
| 7,541,902 | B2 * | 6/2009 | Domejean et al. | 335/201 |
| 7,782,162 | B2 | 8/2010 | Nishida | |
| 8,198,964 | B2 * | 6/2012 | Yoshihara et al. | 335/131 |
| 2008/0030289 | A1 * | 2/2008 | Kralik | 335/201 |
| 2009/0072935 | A1 | 3/2009 | Yuba et al. | |

FOREIGN PATENT DOCUMENTS

| | | |
|---|---|---|
| EP | 1 923 898 | 5/2008 |
| JP | 2658170 | 9/1997 |
| JP | 2001-176370 | 6/2001 |
| JP | 2009-087918 | 4/2009 |

* cited by examiner

*Primary Examiner* — Alexander Talpalatski
(74) *Attorney, Agent, or Firm* — IPUSA, PLLC

(57) ABSTRACT

A disclosed electromagnetic relay includes a fixed contact, a movable contact provided in a movable contact spring, an electric magnet causing the movable contact to contact the fixed contact by applying force via an arming unit, a magnet generating a magnetic field between the fixed contact and the movable contact, and yokes made of a magnetic material, wherein the yokes are arranged in parallel to interpose the fixed contact and the movable contact between the yokes and to apply the magnetic field generated by the magnet to an area where the fixed contact and the movable contact exist, and insulating portions are provided on inner surfaces of the yokes facing the fixed contact and the movable contact, respectively.

10 Claims, 13 Drawing Sheets

ELECTROMAGNETIC RELAY AND METHOD OF MANUFACTURING THE SAME

CROSS-REFERENCE TO RELATED APPLICATIONS

This patent application is based upon and claims the benefit of priority of Japanese Patent Application No. 2011-127740 filed on Jun. 7, 2011, Japanese Patent Application No. 2011-127741 filed on Jun. 7, 2011, and Japanese Patent Application No. 2011-127742 filed on Jun. 7, 2011, the entire contents of which are incorporated herein by reference.

BACKGROUND OF THE INVENTION

1. Field of the Invention

The present invention generally relates to an electromagnetic relay and a method of manufacturing the electromagnetic relay.

2. Description of the Related Art

An electromagnetic relay such as a relay is an electronic component which controls electric power to be turned on or off by using an electric magnet. If the above electromagnetic relay is used to control high voltage or direct current, arcs may be generated between contacts of the electromagnetic relay to thereby shorten its operating life of the electromagnetic relay.

Therefore, an example of an improved electromagnetic relay includes a permanent magnet in the vicinity of its contacts. With this example of the electromagnetic relay, arcs generated at a time of separating the contacts are cleared off by applying a force generated by a magnetic field of the permanent magnet. Thus, the power may be turned off within a short time.

An example of a switch may suppress damage caused by arcs in contacts by providing an arc runner in the vicinity of the contacts.

Although arcs may be quickly broken by methods described in Patent Documents 1 to 3, the arcs in the contacts may not be prevented from being generated, so that the arcs are still generated for a short time. Therefore, there is a case where the contacts and parts in the vicinity of the contacts are damaged by the arcs. Then, the operating life of the electromagnetic relay is shortened to thereby degrade safety and reliability of the electromagnetic relay.

Further, if a casing of an electromagnetic relay is formed by a resin material such as a molding resin, generated arcs may contact the resin material to thereby generate an organic gas from the resin material. In this case, if a component of the generated organic gas adheres to a contact or the like, an electric conduction failure may be generated in the contacts or the like. Especially, a yoke or the like made of a magnetic material may be used to efficiently apply a magnetic field in the vicinity of the contacts. The generated arcs are apt to be attracted by the above yoke. Then, the attracted arcs may be easily transferred to the resin material to thereby generate an organic gas. Further, heat generated by the arcs attracted by the yoke or the like is transferred to the permanent magnet. Then, there are problems that the temperature of the permanent magnet is increased to weaken the magnetic power of the permanent magnet.

The embodiments described herein are provided in consideration of the above. An object of the present invention is to provide an electromagnetic relay with high reliability and safety which has a structure of preventing arcs from being attracted in which a yoke for applying a magnetic field to contacts and positions near the contacts. Especially, the object of the present invention is to provide an electromagnetic relay with high reliability and safety used for a voltage higher than that of a commercial power supply, a direct power source, and so on.

Another object of the present invention is to provide a manufacturing method of an electromagnetic relay with high reliability and safety in which arcs can be rapidly removed from contacts and, if the arcs are generated, the operating life of the electromagnetic relay is not affected by the generated arcs. Especially, another object of the electromagnetic relay and the manufacturing method of the electromagnetic relay is to ensure high reliability and safety even if the voltage higher than that of the commercial power supply, the direct power source and so on are controlled by the electromagnetic relay.

[Patent Document 1] Japanese Laid-open Patent Publication No. 2001-176370

[Patent Document 2] Japanese Laid-open Patent Publication No. 2009-87918

[Patent Document 3] Japanese Patent No 2658170

SUMMARY OF THE INVENTION

Accordingly, embodiments of the present invention may provide an electromagnetic relay including a fixed contact; a movable contact provided in a movable contact spring; an electric magnet causing the movable contact to contact the fixed contact by applying force to the movable contact spring via an arming unit; a magnet generating a magnetic field between the fixed contact and the movable contact; and a pair of yokes made of a magnetic material, wherein the yokes are arranged in parallel to interpose the fixed contact and the movable contact between the yokes and to apply the magnetic field generated by the magnet to an area where the fixed contact and the movable contact exist, and a pair of insulating portions are provided on inner surfaces of the pair of yokes facing the fixed contact and the movable contact, respectively.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

Figure 1:
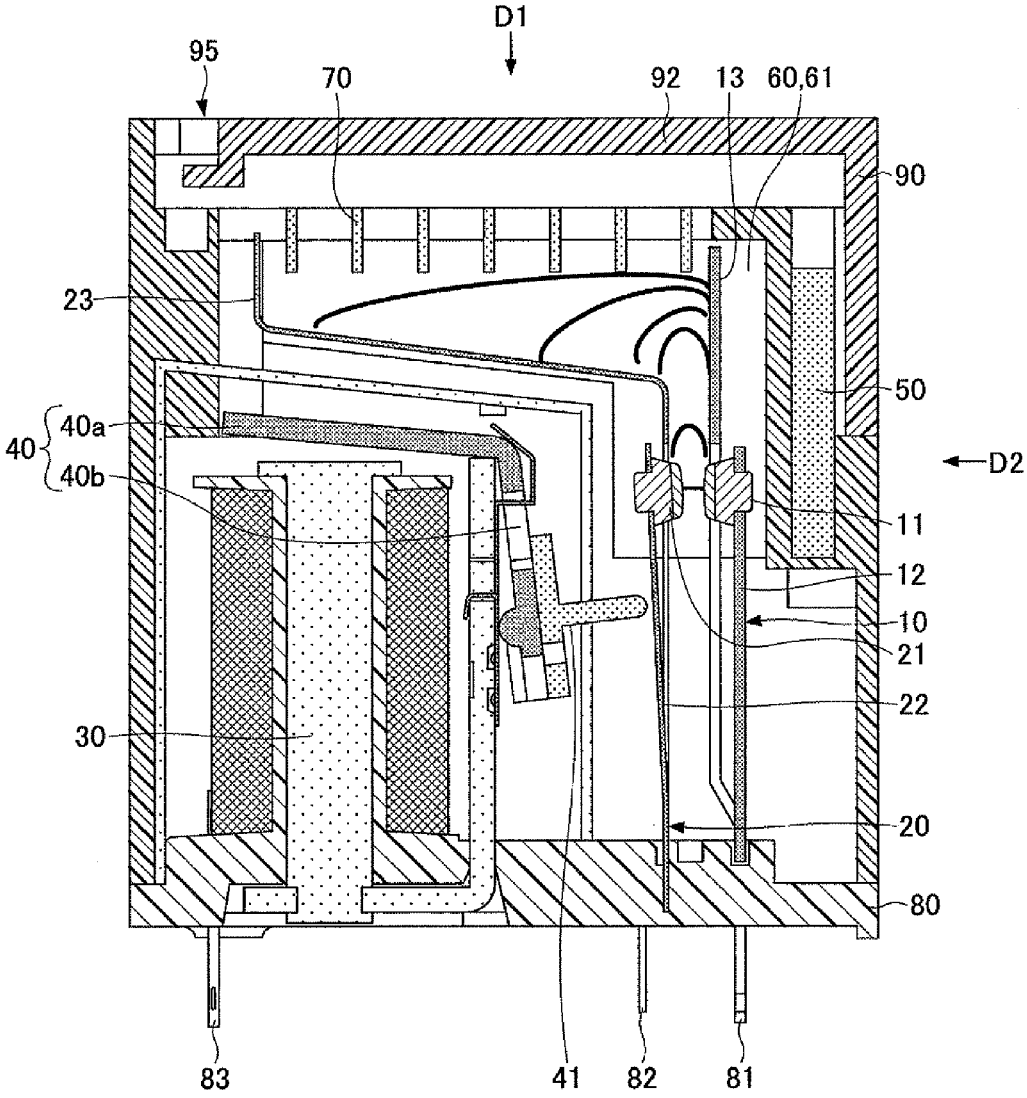
FIG. 1 illustrates a structure of an electronic connector of an embodiment.
Figure 2:
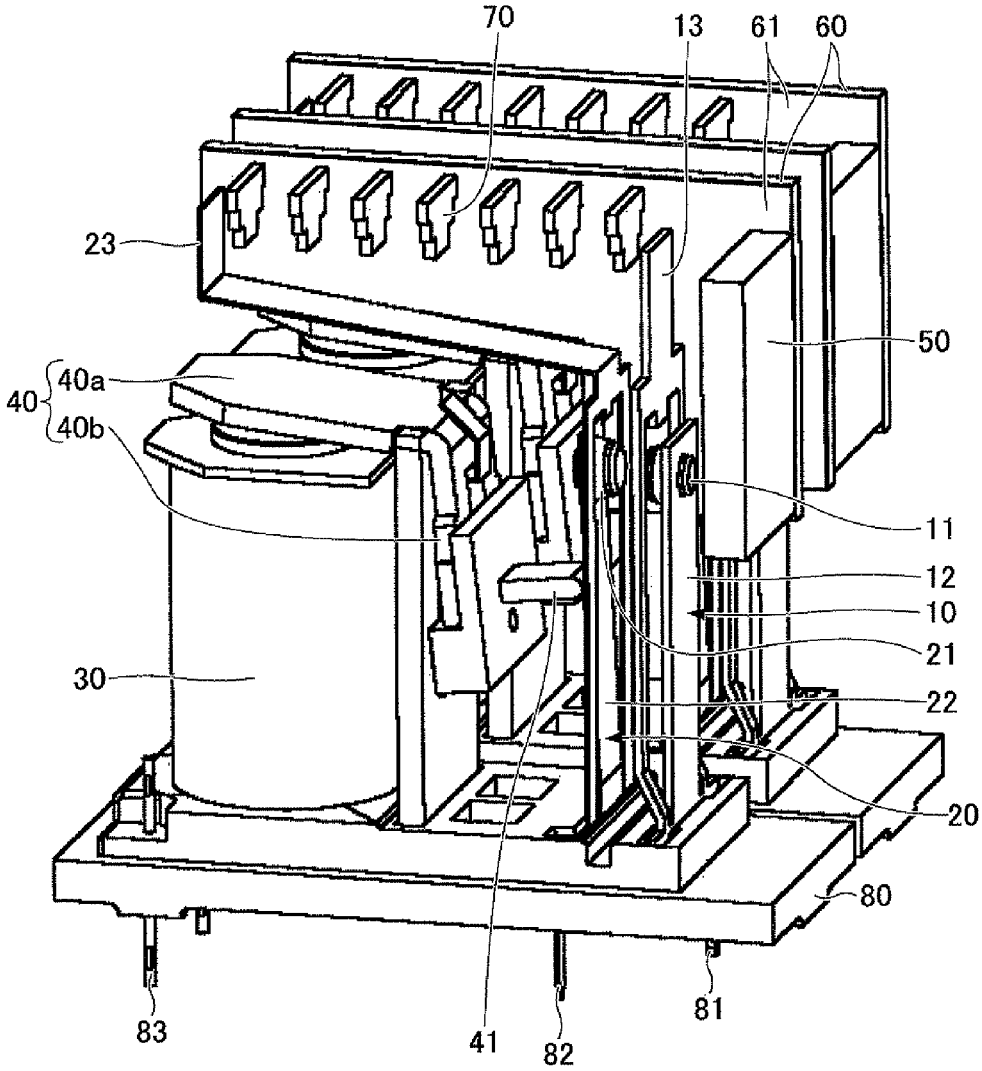
FIG. 2 illustrates a structure of an electromagnetic relay of the embodiment.

A description is given below, with reference to the FIG. 1 through FIG. 13 of embodiments of the present invention. The same reference symbols are attached to the same parts or the like and description of the parts is omitted.

(Electromagnetic Relay)

The electromagnetic relay 1 of the embodiments of the present invention is described. The electromagnetic relay 1 includes a fixed contact 11, a fixed contact spring 12, a fixed contact unit 10 having a fixed side arc runner 13, a movable contact 21, a movable contact spring 22, and a movable contact unit 20 having a movable side arc runner 23. On a side where the movable contact unit 20 is provided, an electric magnet unit 30 is provided. An arming unit 40 is provided on an end of the electric magnet unit 30. The arming unit 40 is bent to be like a letter of "V". The arming unit 40 is connected to the electromagnetic relay 1 so as to be movable around an axis at the center of the arming unit 40. The arming unit 40 has a first arm 40*a* in contact with the electric magnet unit 30 and a second arm 40*b* causing to operate a card 41 described later.

With the embodiment, the electric magnet unit 30 is formed by twin coils. When comparing a single coil with a twin coil, the diameter of the single coil is ordinarily 2.5 times of that of the twin coil. Therefore, the electromagnetic relay 1 can be further miniaturized by using the twin coil.

The electromagnetic relay 1 of the embodiment includes a permanent magnet 50 for removing arcs and a yoke 60 made of a magnetic material. An insulating portion 61 is provided on surfaces of the yokes 60 which face each other while sandwiching the fixed contact 11 and the movable contact 21.

When an electric current flows through the electric magnet unit 30 of the electromagnetic relay 1, a magnetic field is generated in the electric magnet unit 30, and the first arm 40*a* of the arming unit 40 formed by a magnetic material such as iron is in contact with the electric magnet unit 30. With this, the arming unit 40 is movable around an axis positioned at a center of the arming unit 40. Then, the moveable contact spring 22 is pushed on a side of the fixed contact unit 10 via the card 41 provided in the second arm 40*b*. Thus, the movable contact 21 contacts the fixed contact 11. The electromagnetic relay 1 is turned on when the movable contact 21 electrically contacts the fixed contact 11 as described above.

By turning off the electric current flowing through the electric magnet unit 30, a magnetic field generated in the electric magnet unit 30 disappears. Thus, a force attracting the first arm 40*a* of the arming unit 40 disappears, too. Then, a restoring force of the movable contact spring 22 causes the movable contact to be separated from the fixed contact. The electromagnetic relay 1 is turned off when the electric connection between the fixed contact 11 and the movable contact 21 is cancelled.

At this time, arcs are generated between the fixed contact 11 and the movable contact 21. In the electromagnetic relay 1, the yoke 60 is provided on both sides of the area having the fixed contact 11 and the movable contact 21 to apply a magnetic field to remove the arcs. The arcs can be transferred to the fixed side arc runner 13 and the movable side arc runner 23. By transferring the arcs generated in the fixed contact 11 and the movable contact 21 to the fixed side arc runner 13 and the movable side arc runner 23, the arcs are quickly removed from the fixed contact 11 and the movable contact 21. Thus, it is possible to prevent damage to the fixed contact 11 and the movable contact 21 from the arcs.

The fixed side arc runner 13 is formed in a longitudinal direction of the fixed contact spring 12 of the fixed contact unit 10 from a first end on a side of a base 80 to a second end opposite to the first end of the fixed side arc runner 13 beyond the fixed contact. The movable side arc runner 23 is formed in a longitudinal direction of the movable contact spring 22 of the movable contact unit 20. Beyond the movable contact, the movable side arc runner 23 is gradually apart from the movable contact and also apart from the fixed side arc runner 13 along a direction from a first end on a side of the base 80 toward a second end opposite to the first end of the movable side arc runner 23. By gradually separating the fixed side arc runner 13 from the movable side arc runner 23, the distance between the fixed side arc runner 13 and the movable side arc runner 23 is also increased to thereby enable the arcs smoothly running while increasing intervals of the arcs.

An arc extinguishing grid 70 is provided between the second end of the fixed side arc runner 13 and the second end of movable side arc runner 23. The arcs run to the second end of the fixed side arc runner 13 and the second end of the movable side arc runner 23, and may be extinguished by the arc extinguishing grid 70. Therefore, in order to efficiently and smoothly extinguish the arcs with the arc extinguishing grid 70, the arc extinguishing grid 70 is preferably provided between the second end of the fixed side arc runner 13 and the second end of the movable side arc runner 23.

The fixed contact unit 10, the movable contact unit 20, and the electric magnet unit 30 are mounted on a first surface of the base 80. Terminals 81, 82 and 83 are mounted on the other surface of the base 80. The terminals 81, 82 and 83 are connected to the fixed contact unit 10, the movable contact unit 20, and the electric magnet unit 30, respectively. The case 90 and the cover 92 being parts of a casing are formed to cover a fixed contact unit 10, the movable contact unit 20, the electric magnet unit 30, the arming unit 40, the permanent magnet 50, the yoke 60, the arc extinguishing grid 70 and so on which are arranged on the first surface of the base 80 and are connected to the base 80. Further, although an exhaust port 95 is formed by the case 90 and the cover 92 in the electromagnetic relay 1 of the embodiment, the exhaust port 95 is described in detail later.

(Magnetic Flux and Electric Current)

Figure 3:
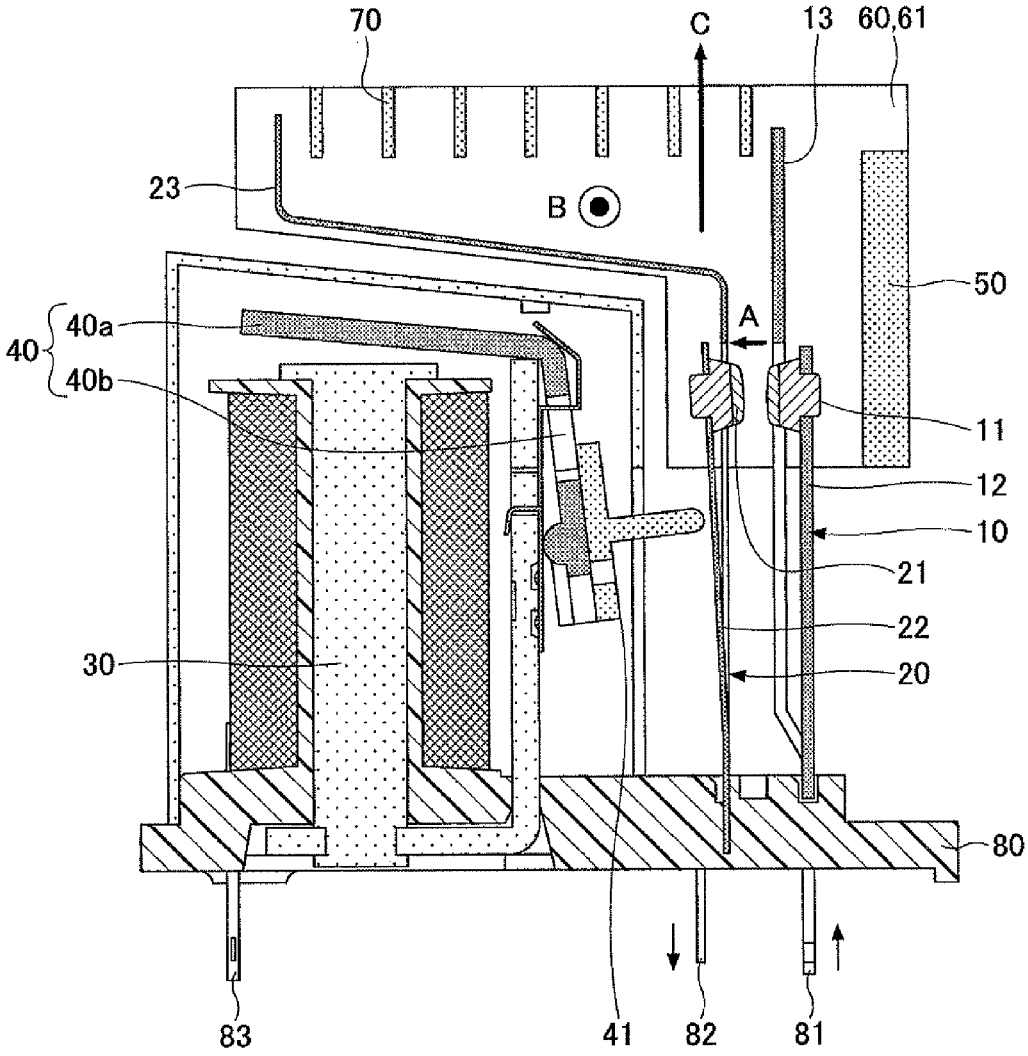
FIG. 3 schematically illustrates the structure of the electromagnetic relay of the embodiment.
Figure 4:
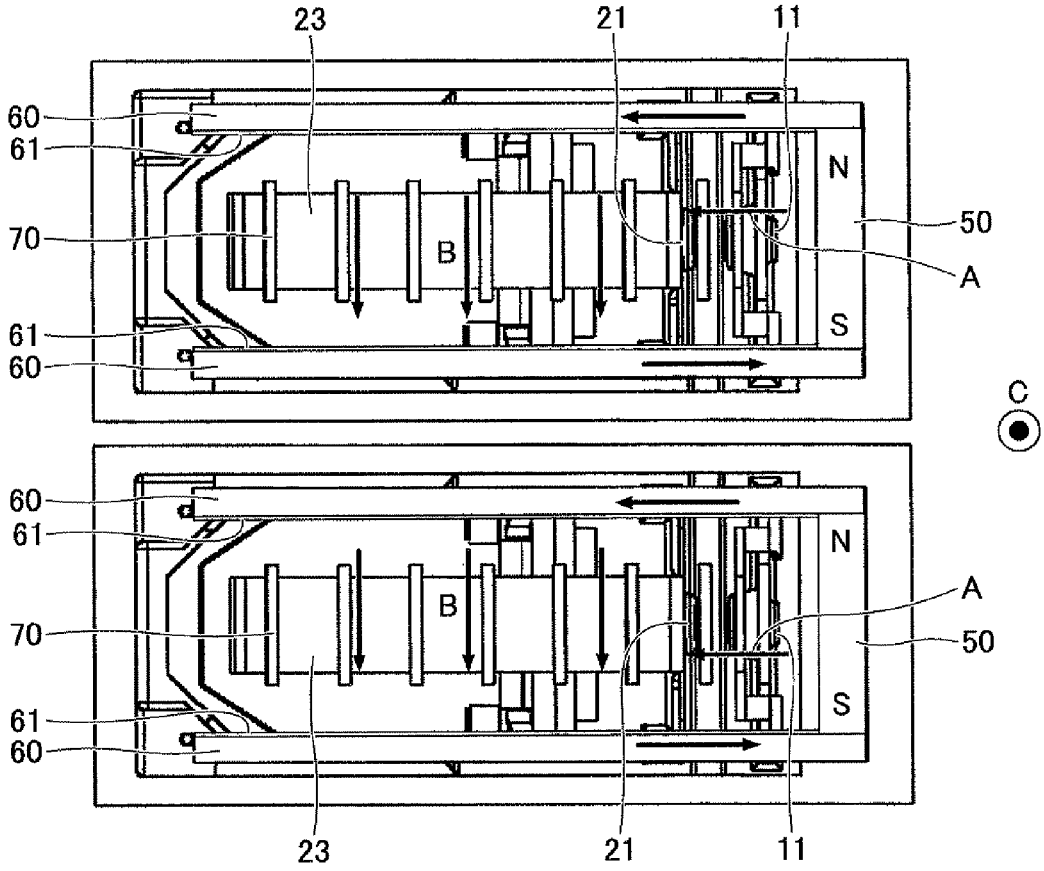
FIG. 4 schematically illustrates the structure of the electromagnetic relay of the embodiment.
Figure 5:
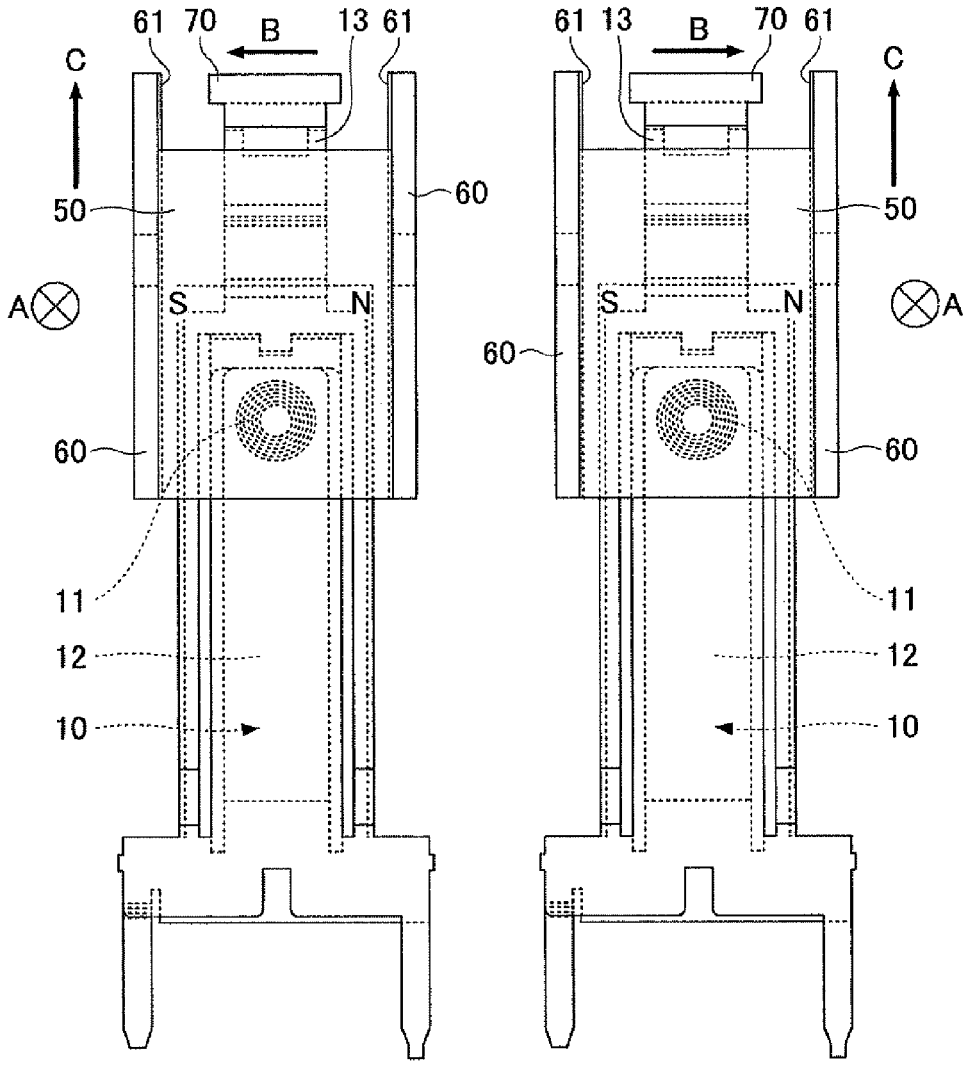
FIG. 5 schematically illustrates the structure of the electromagnetic relay of the embodiment.

Referring to FIG. 3 to FIG. 5, the direction of a magnetic flux and the direction of an electric current in the electromagnetic relay 1 of the embodiment are described next. Referring to FIG. 3 to FIG. 5, the direction of the electric current is designated by an arrow A, the direction of the magnetic flux is designated by an arrow B, and the direction of a force applied to the arcs (a force applied to electrons by a magnetic field) is designated by an arrow C. FIG. 3 illustrates a portion of the electromagnetic relay 1 viewed from the same direction as that in FIG. 1. FIG. 4 illustrates a portion of the electromagnetic relay 1 viewed in a direction of the arrow D1 in FIG. 1, and FIG. 5 illustrates a portion of the electromagnetic relay 1 viewed in a direction of the arrow D2 in FIG. 1.

At first, the permanent magnet 50 is described. The permanent magnet may be a samarium-cobalt magnet, a neodymium magnet, a ferrite magnet or the like. The samarium-cobalt magnet is preferable in view of a magnetic force and durability.

The two yokes 60 are provided so as to sandwich the fixed contact 11 and the movable contact 21 on both sides of the two yokes 60. The yoke 60 is made of a material containing iron, cobalt, or nickel, for example, and shaped like a plate. The yokes are arranged to apply the magnetic field, which is generated by the permanent magnet 50, in a direction substantially perpendicular to the longitudinal direction of the fixed contact spring 12 and the longitudinal direction of the movable contact spring 22. Specifically, the yokes 60 are shaped like a flat plate and installed so as to be substantially parallel each other. One of the yokes 60 contacts the south (S) pole and the other one of the yokes 60 contacts the north (N) pole by a magnetic force.

A magnetic flux generated by the permanent magnet 50 exists in between the pair of yokes 60 thereby generating a magnetic field in a space between the yokes 60. There is the fixed contact 11 and the movable contact 21 in the space between the yokes 60. The direction of the magnetic flux is substantially perpendicular to the longitudinal directions of the fixed contact spring and the movable contact spring and is substantially perpendicular to a direction of separating the movable contact 21 from the fixed contact 11. The magnetic field generated by the permanent magnet 50 exists strongly in a predetermined direction in the space sandwiched by the yokes 60 of the embodiment. The fixed contact 11, the movable contact 21, the fixed side arc runner 13, the movable side arc runner 23 and the are extinguishing grid 70 exist in the space.

As described, within the embodiment, the direction of the magnetic flux generated by the permanent magnet and sandwiched by the yokes 60, the direction of separating the movable contact 21 from the fixed contact 11, and the longitudinal direction of the fixed side arc runner 13 are mutually orthogonal (perpendicular).

Meanwhile, an electric current flows from the fixed contact 11 to the movable contact 21. Said differently, when the movable contact 21 contacts the fixed contact 11, the electric current flows form the terminal 81 connected to the fixed contact unit 10, through the fixed contact 11 and the movable contact 21 to the terminal 82 connected to the movable contact unit 20.

Since the electric current flows from the fixed contact to the movable contact 21, electrons flow from the movable contact 21 to the fixed contact 11. Because the movable contact spring 22 ordinarily makes the movable contact 21 move, the movable contact spring 22 is formed thinner than the fixed contact spring 12. Therefore, a thermal capacity of the movable contact spring 22 is small. Therefore, when arcs are generated between the fixed contact 11 and the movable contact 21, the temperature of a contact point which electrons hit becomes high. Therefore, the circuit of the electromagnetic relay 1 is configured such that the electric current flows from the fixed contact 11 to the movable contact 21.

Specifically, the fixed contact spring 12 is thick enough to obtain a great thermal capacity. When electrons emitted from the movable contact 21 hit the fixed contact 11, a thermal influence received by the fixed contact spring 12 or the like upon hitting of the electrons is small. However, because the movable contact spring 22 is thin, the thermal capacity of the movable contact spring 22 is small. Therefore, when the electrons hit the movable contact 11, the probability of melting and deforming the movable contact spring 22 by the thermal influence caused by hitting of the electrons is high. Therefore, the circuit of the electromagnetic relay 1 is configured such that the electric current flows from the fixed contact 11 to the movable contact 21, said differently, the electrons move from the movable contact 21 to the fixed contact 11.

(Insulating Portion)

Next, an insulating portion 61 is described. The reason why the generated arcs are apt to be attracted by the yokes 60 is that the magnetic material forming the yokes 60 is a metallic material containing a magnetic material containing Fe, Ni and Co. Therefore, the yokes 60 have electrical conductivity, and the generated arcs may be prone to move toward the yokes 60 due to attraction by the electrical conductivity of the yokes 60. By covering the sides of the yokes 60 on which the arcs are generated by an insulating material, the metallic material may be shielded by the insulating material to thereby prevent the arcs from moving toward the yokes.

In the electromagnetic relay 1 of the embodiment, an insulating portion 61 is provided on surfaces of the yokes 60 on which the yokes 60 face each other. Therefore, it is possible to prevent the arcs generated between the facing surfaces of the yokes 60 from being attracted by and moving toward the yokes 60.

The insulating portion 61 is made of an insulating material, specifically an inorganic insulating material such as aluminum oxide, silicon oxide, aluminum nitride and ceramics or an organic insulating material such as a resin material. The insulating portion 61 may be shaped like a flat plate so as to cover the yoke 60 or formed by coating an insulating material on the surface of the yoke 60. The resin material is a fluorine resin, a poly-p-xylylene resin or the like.

Since the temperature of the portion in contact with the arcs becomes high, in order to prevent the insulating portion 61 from being melted by the heat, it is preferable that the melting point of the material of the insulating portion 61 is high enough to prevent such melting. Further, the insulating portions are formed to substantially cover the mutually facing surfaces of the yokes 60. In a space between the insulating portions formed on the yokes 60, the fixed contact 11, the movable contact 21, the fixed side arc runner 13, the movable side arc runner 23 and the arc extinguishing grid 70 are sandwiched.

(The Relationship Between the Electric Magnet Unit and the Permanent Magnet)

The electromagnetic relay 1 includes the electric magnet unit 30 and the permanent magnet 50. Both of the electric magnet unit 30 and the permanent magnet 50 generate magnetic fields. However, the electric magnet unit 30 has a function of making the movable contact 21 contact or separate from the fixed contact 11, and the permanent magnet has a function of removing arcs generated between the fixed contact 11 and the movable contact 21. Thus, the electric magnet unit 30 and the permanent magnet 50 have different functions.

Therefore, if the positions of the electric magnet unit 30 and the permanent magnet 50 are close, there is a probability that a magnetic field generated by one of the electric magnet unit 30 and the permanent magnet 50 affects the other one of the electric magnet unit 30 and the permanent magnet 50. Especially, when the electromagnetic relay 1 is miniaturized, there is a case where a malfunction or the like occurs. Therefore, referring to the electromagnetic relay 1 of the embodiment illustrated in FIG. 3, the electric magnet unit 30 is arranged at an upper left portion of the electromagnetic relay 1 so as to sandwich the fixed contact and the movable contact 21, and the permanent magnet 50 is arranged at an upper right portion of the electromagnetic relay 1. Said differently, the fixed contact 11 and the movable contact 21 are positioned between the electric magnet unit 30 and the permanent magnet 50. By separating positions of the electric magnet unit 30 and the permanent magnet 50 as described above, mutual influences between the magnetic fields generated by the electric magnet unit 30 and the permanent magnet 50, said differently influences of leakage fields from the magnetic fields can be prevented.

Further, in view of miniaturization of the electromagnetic relay 1, the electric magnet unit 30 for moving the movable contact 21 is positioned on the side of the movable contact 21 closer to the movable contact 21 than the side of the fixed contact 11. Meanwhile, the permanent magnet 50 is arranged on the side of the fixed contact 11. In order to apply a strong magnetic field in between the fixed contact 11 and the movable contact 21, it is preferable to arrange the permanent magnet 50 in the vicinity of the fixed contact 11 and the movable contact 21. When the yokes 60 are provided, it is preferable to arrange the permanent magnet 50 in the vicinity of the fixed contact 11 and the movable contact 21.

(The Fixed Side Arc Runner and the Movable Side Arc Runner)

Next, the fixed side arc runner and the movable side arc runner of the electromagnetic relay 1 of the embodiment are described.

Figure 6:
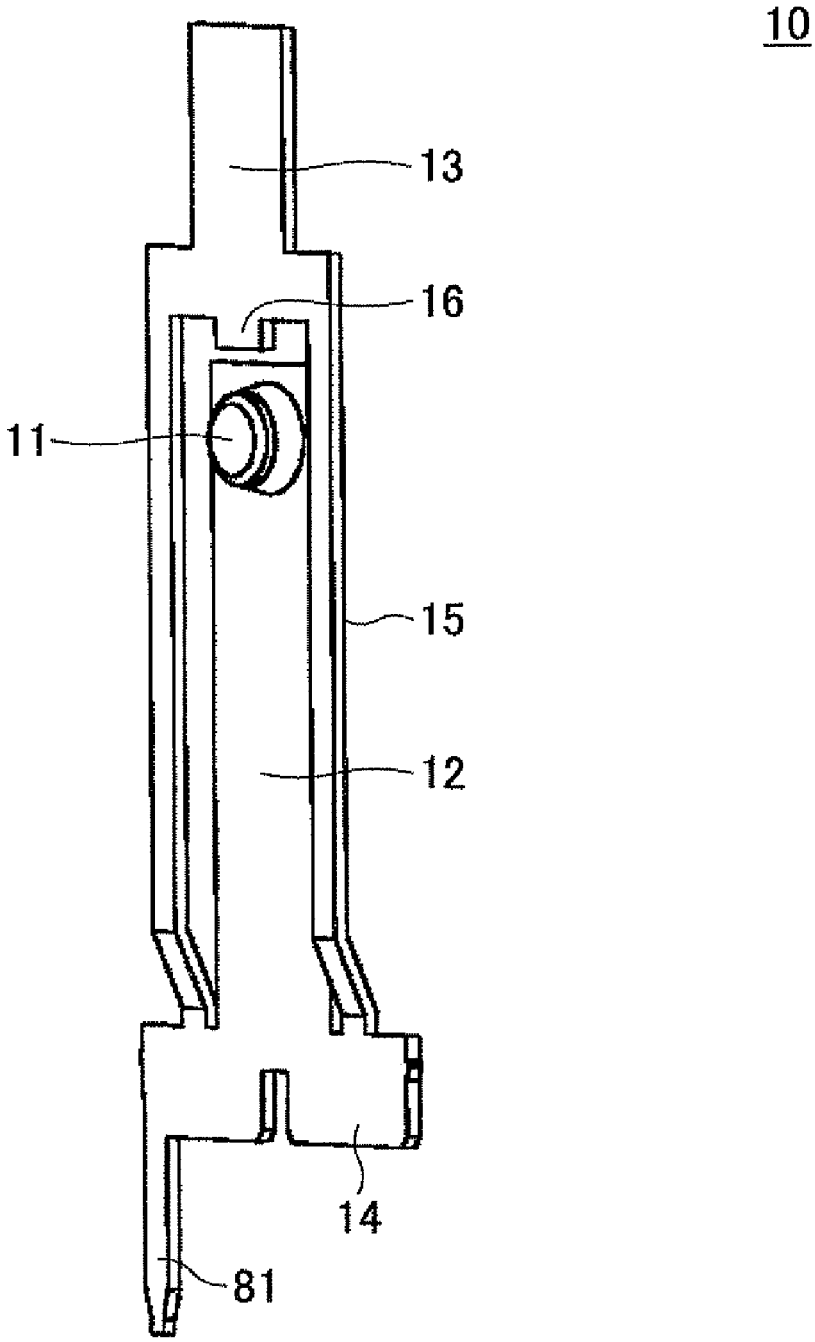
FIG. 6 is a perspective view of a fixed contact unit of the electromagnetic relay of the embodiment.

Referring to FIG. 6, the fixed contact unit 10 is formed by punching a sheet of metallic plate and processing by bending the sheet of metallic plate. The fixed contact 11 is provided in the vicinity of the second end of the fixed contact spring 12. The first end of the fixed contact spring 12 is connected to the fixed side supporting portion 14. A fixed side frame portion 15 connected to the fixed side supporting portion 14 so as to surround the fixed contact spring 12. Therefore, the fixed contact spring 12 and the fixed side frame portion 15 are formed so as to be substantially parallel.

Specifically, three sides of the fixed contact spring 12 are formed by punching out the metallic plate, and the fixed side frame portion 15 is formed around the fixed contact spring 12. The fixed contact spring 12 and the fixed side frame portion 15 are connected via the fixed side supporting portion 14 at a portion corresponding to the remaining one side of the fixed contact spring 12 which is not punched out. With this, the fixed contact spring 12 is displaced when the movable contact 21 contacts and pushes the fixed contact 11. Therefore, the fixed contact spring 12 can be biased as a spring. Meanwhile, the fixed side frame portion 15 maintains its outer shape so as to be a predetermined shape without being deformed when the movable contact 21 contacts the fixed contact 11. A fixed side tab 16 to be described later is maintained to be at a predetermined position.

The fixed side arc runner 13 is provided on the second end of the fixed side frame portion, which is opposite to the first end of the fixed side supporting portion 14, in the longitudinal direction of the fixed contact spring. Referring to FIG. 6, the fixed side tab 16 is provided in the fixed side frame portion 15 toward the side of the fixed contact 11, i.e., in a direction opposite to the longitudinal direction toward the second end of the fixed side frame portion 15 (the fixed side arc runner 13). The fixed contact spring 12 is bent in the vicinity of a connecting portion between the fixed side supporting portion 14 and the fixed side frame portion 15 so as to be adjacent to the fixed side tab 16.

Figure 7:
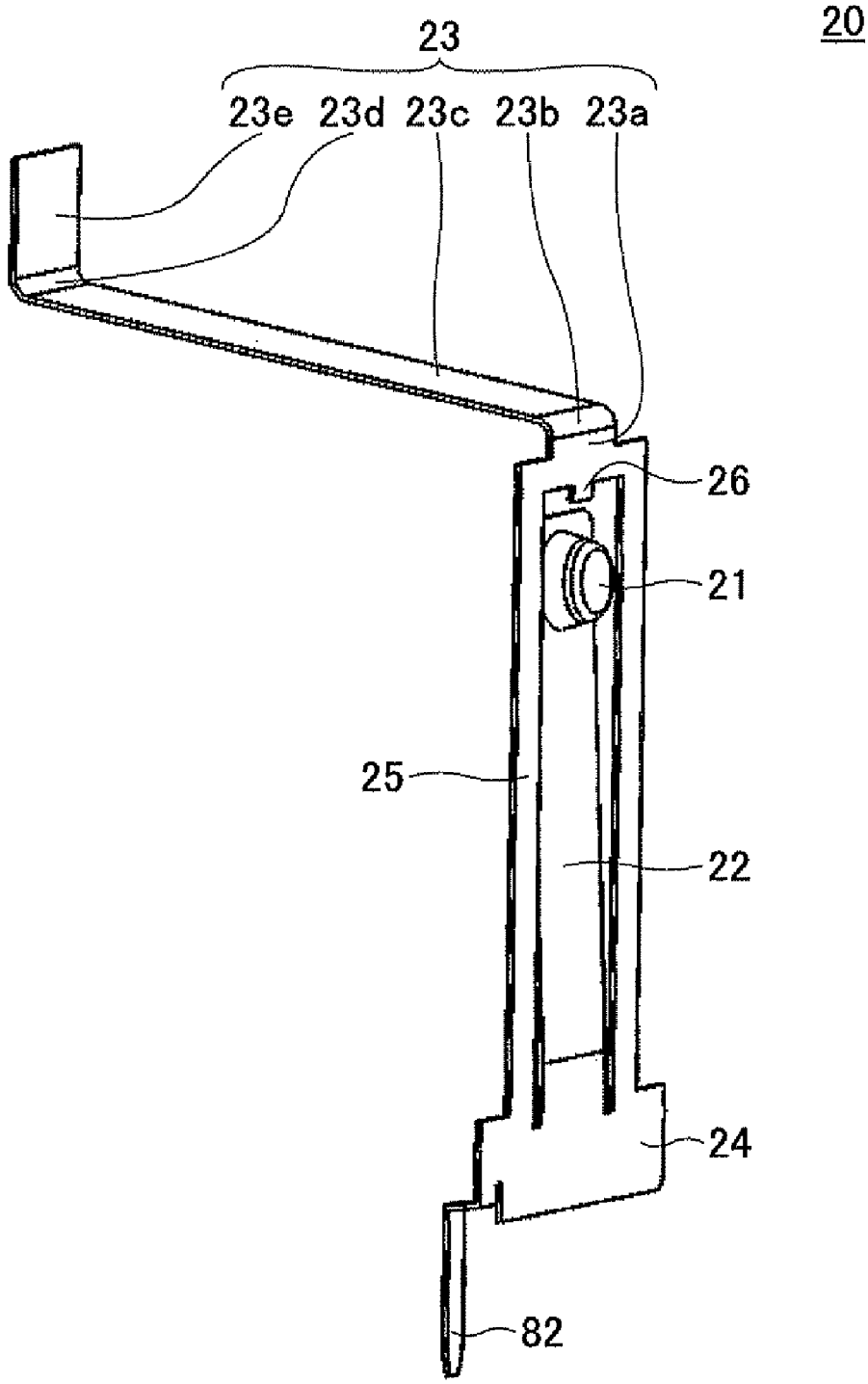
FIG. 7 is a perspective view of a movable contact unit of the electromagnetic relay of the embodiment.

Referring to FIG. 7, the movable contact unit 20 is formed by punching out a sheet of metallic plate and processing by bending the sheet of metallic plate. The movable contact 21 is provided in the vicinity of a second end of the movable contact spring 22. The movable contact spring 22 is connected to a movable side supporting portion 24 at a first end opposite to the second end. A movable side frame portion 25 connected to the movable side supporting portion 24 so as to surround the periphery of the movable contact spring 22. The movable contact spring 22 is substantially parallel to the movable side frame portion 25.

Specifically, three sides of the movable contact spring 22 are formed by punching out the metallic plate, and the movable side frame portion 25 is formed around the movable contact spring 22. The movable contact spring 22 and the movable side frame portion 25 are connected via the movable side supporting portion 24 at a portion corresponding to the remaining one side of the movable contact spring 22 which is not punched out. With this, the movable contact spring 22 is displaced when the movable contact 21 contacts and pushes the fixed contact 11. Therefor; the movable contact spring 22 can be biased as a spring. Meanwhile, the movable side frame portion 25 maintains its outer shape so as to be a predetermined shape without being deformed when the movable contact 21 contacts the fixed contact 11. A movable side tab 26 to be described later is maintained to be at a predetermined position.

The movable side arc runner 23 is provided on the second end of the movable side frame portion 25 opposite to the movable side supporting portion 24. The movable side arc runner 23 includes a connecting portion 23*a* formed along the longitudinal direction of the movable side frame portion 25, a linear portion 23*c* bent at the bending portion 23*b*, and an outer side portion 23*e* formed by bending the linear portion 23*c* at the bending portion 23*d*. The angle between the longitudinal direction of the linear portion 23*c* toward the outer side portion 23*e* and the movable side frame portion 25 is smaller than the right angle. The direction along the outer side portion 23*e* is substantially parallel to the longitudinal direction of the movable side frame portion 25 at the bent portion 23*d*.

The bent portions 23*b* and 23*d* are shaped to have a predetermined roundness. The generated arcs can be smoothly moved at the bent portions 23*b* and 23*d*. The movable side frame portion 25 has a movable side tab 26 extending toward the movable contact 21 from its side of movable contact 21 on a side opposite to the movable side arc runner 23.

Within the embodiment, the angle between the linear portion 23*c* and the movable side frame portion 25 in the movable side arc runner 23 is smaller than the right angle. The linear portion 23*c* is gradually apart from the fixed side arc runner 13 toward the outer side portion 23*e* of the movable side arc runner 23. With this feature, the arcs can be smoothly moved through the linear portion 23*c*. The angle between the linear portion 23*c* and the movable side frame portion 25 is counted based on a line along the longitudinal direction of the movable side frame portion 25. When the linear portion 23*c* is not bent from the movable side frame portion 25, the angle is 0°. Further, the movable contact spring 22 is bent in the vicinity of a connecting portion between the movable side supporting portion and the movable contact spring 22 so that the movable side tab approaches the movable contact 21.

Within the embodiment, the fixed side supporting portion 14 of the fixed contact unit 10 is fixed to the base 80. The movable side supporting portion 24 of the movable contact unit 20 is fixed to the base 80.

Within the embodiment, the fixed contact unit 10 and the movable contact unit 20 are formed by processing each sheet of metallic plate. Therefore, the electromagnetic relay 1 can be formed at a low cost. Further, there is not a connecting member causing contact resistances between the fixed contact 11 and the fixed side arc runner 13 and between the movable contact 21 and the movable side arc runner 23. Therefore, the resistances are low to thereby further uniform the electric potential between the fixed contact 11 and the fixed side arc runner 13 and the electric potential between the movable contact 21 and the movable side arc runner 23. With this, the arcs generated between the fixed contact 11 and the movable contact 21 are smoothly transferred to the fixed side arc runner 13 and the movable side arc runner 23.

Figure 8:
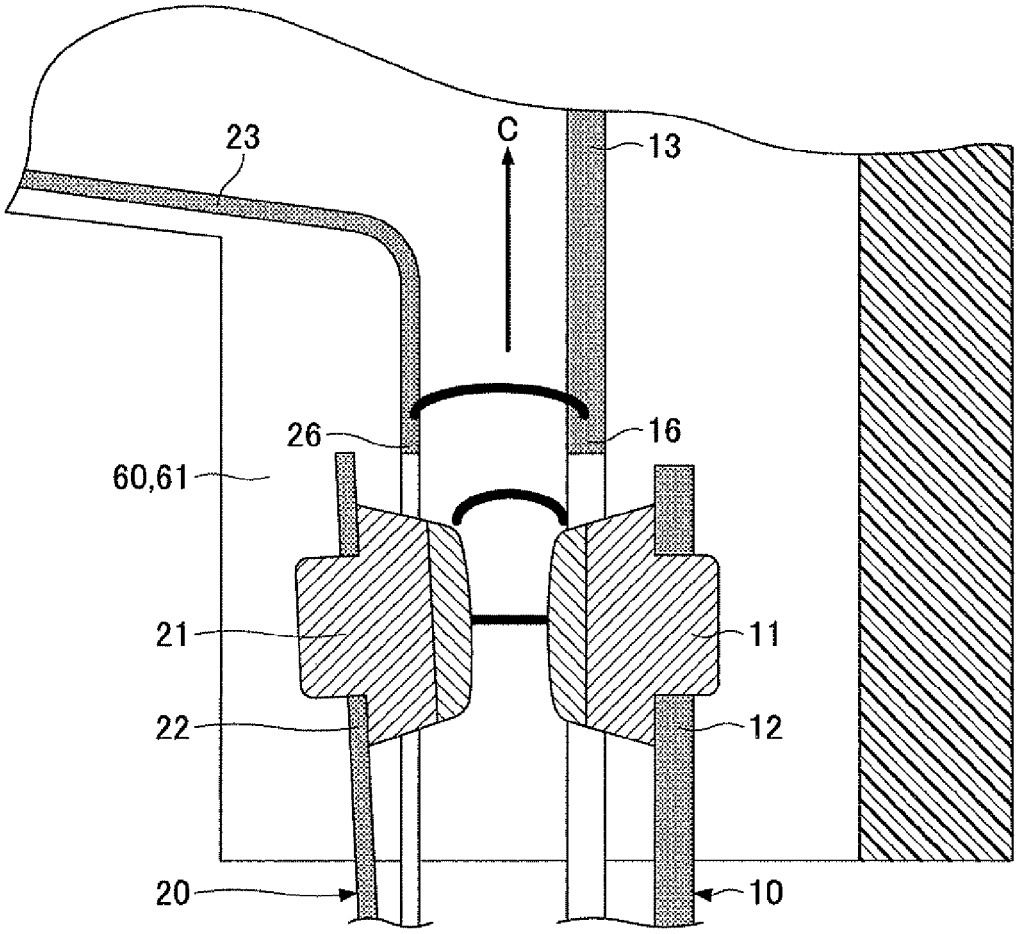
FIG. 8 is an enlarged cross-sectional view of parts of the fixed contact unit and the movable contact unit of the electromagnetic relay of the present embodiment.

FIG. 8 is an enlarged view of a contact portion between the fixed contact 11 and the movable contact 21 of the electromagnetic relay 1 of the embodiment. The fixed contact 11 is formed so as to approach the fixed side tab 16 connected to the fixed side arc runner 13. The movable contact 21 is formed to approach the movable side tab 26 connected to the movable side arc runner 23.

As described, since the fixed contact 11 is adjacent to the fixed side tab 16 and the movable contact 21 is adjacent to the movable side tab 26, arcs are generated when the movable contact 21 is separated from the fixed contact 11. The generated arcs are apt to be transferred from a position between the fixed contact 11 and the movable contact 21 to a position between the fixed side tab 16 and the movable side tab 26. Thereafter, the arcs transferred between the fixed side tab 16 and the movable side tab 26 moves through the fixed side arc runner 13 and the movable side arc runner 23. As described, the arcs generated in between the fixed contact 11 and the movable contact 21 can be transferred to the fixed side arc runner 13 and the movable side arc runner 23 to thereby reduce damage to the fixed contact 11 and the movable contact 21.

Figure 9:
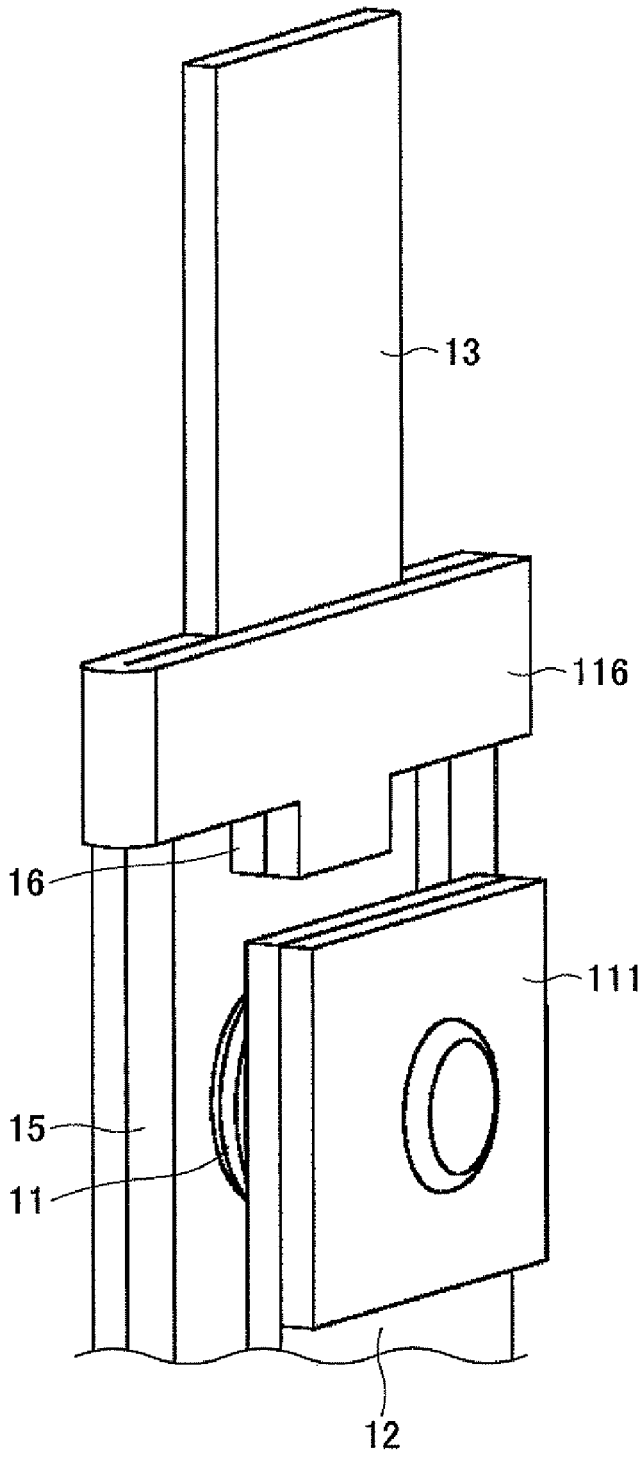
FIG. 9 is a perspective view of a part of the fixed contact unit of the electromagnetic relay of the embodiment.

Within the embodiment, reliability or the like may be further improved by increasing the thermal capacity of the fixed contact 11, the movable contact 21, and neighboring portions of the fixed contact 11 and the movable contact 21. Specifically, as illustrated in FIG. 9, the thermal capacity of the fixed contact 11 may be increased by providing a fixed contact assisting portion 111 for reinforcing the connecting portion between the fixed contact spring 12 and the fixed contact 11. At this time, a fixed side tab assisting portion 116 may be provided in the fixed side tab 16 to which the arcs transfer from the fixed contact 11 to thereby increase the thermal capacity of the fixed side tab 16.

Figure 10:
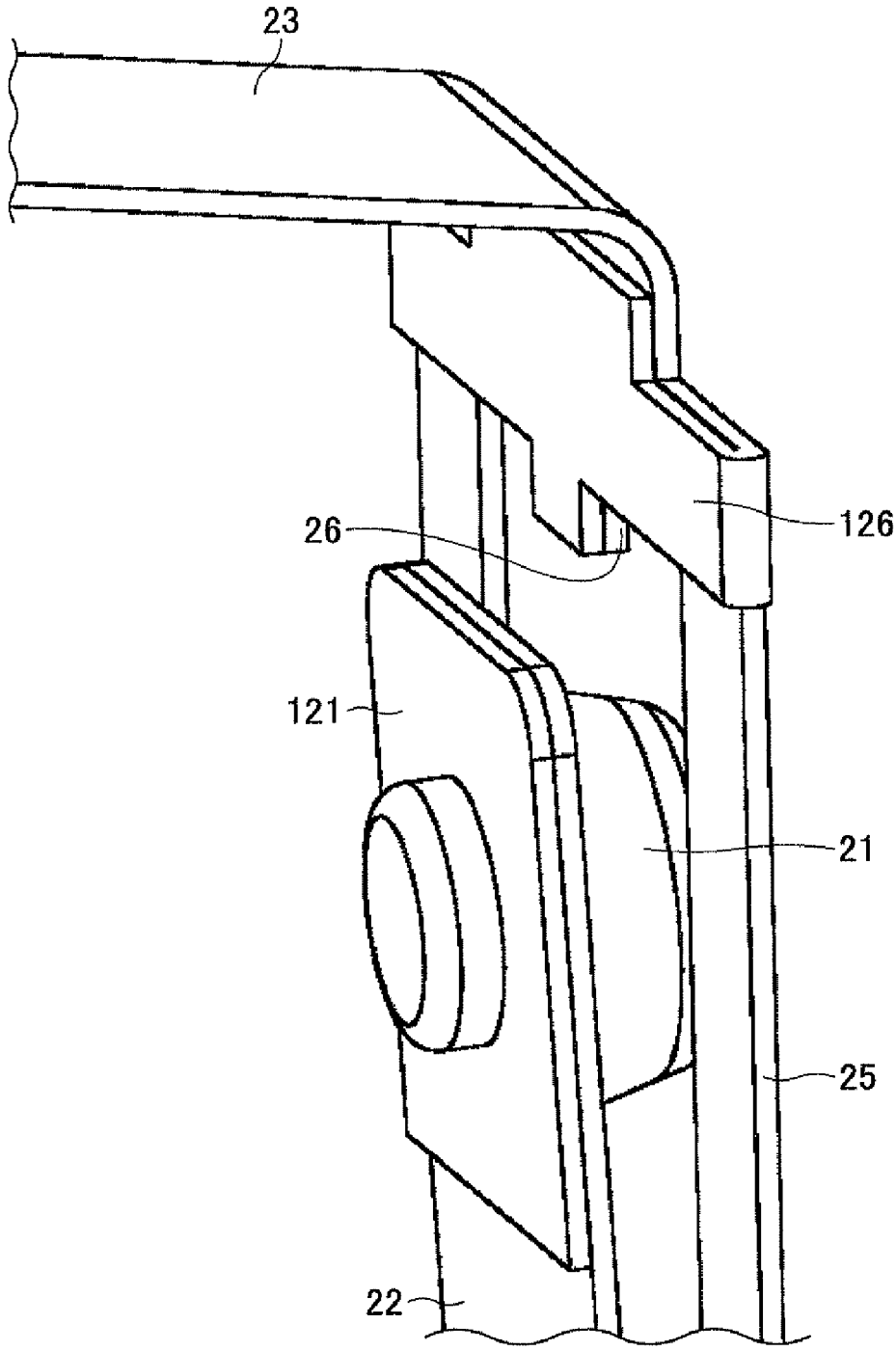
FIG. 10 is a perspective view of a part of another movable contact unit of the electromagnetic relay of the embodiment.

Further, as illustrated in FIG. 10, the thermal capacity of the movable contact 21 may be increased by providing a movable contact assisting portion 121 for reinforcing the connecting portion between the movable contact spring 22 and the movable contact 21. At this time, a movable side tab assisting portion 126 may be provided in the movable side tab 26 to which the arcs transfer from the movable contact 21 to thereby increase the thermal capacity of the movable side tab 26.

With this, the fixed contact 11 and the movable contact 21 become less damaged by the arcs thereby enhancing the reliability and the safety.

(Manufacturing Method of the Electromagnetic Relay 1)

Figure 11:
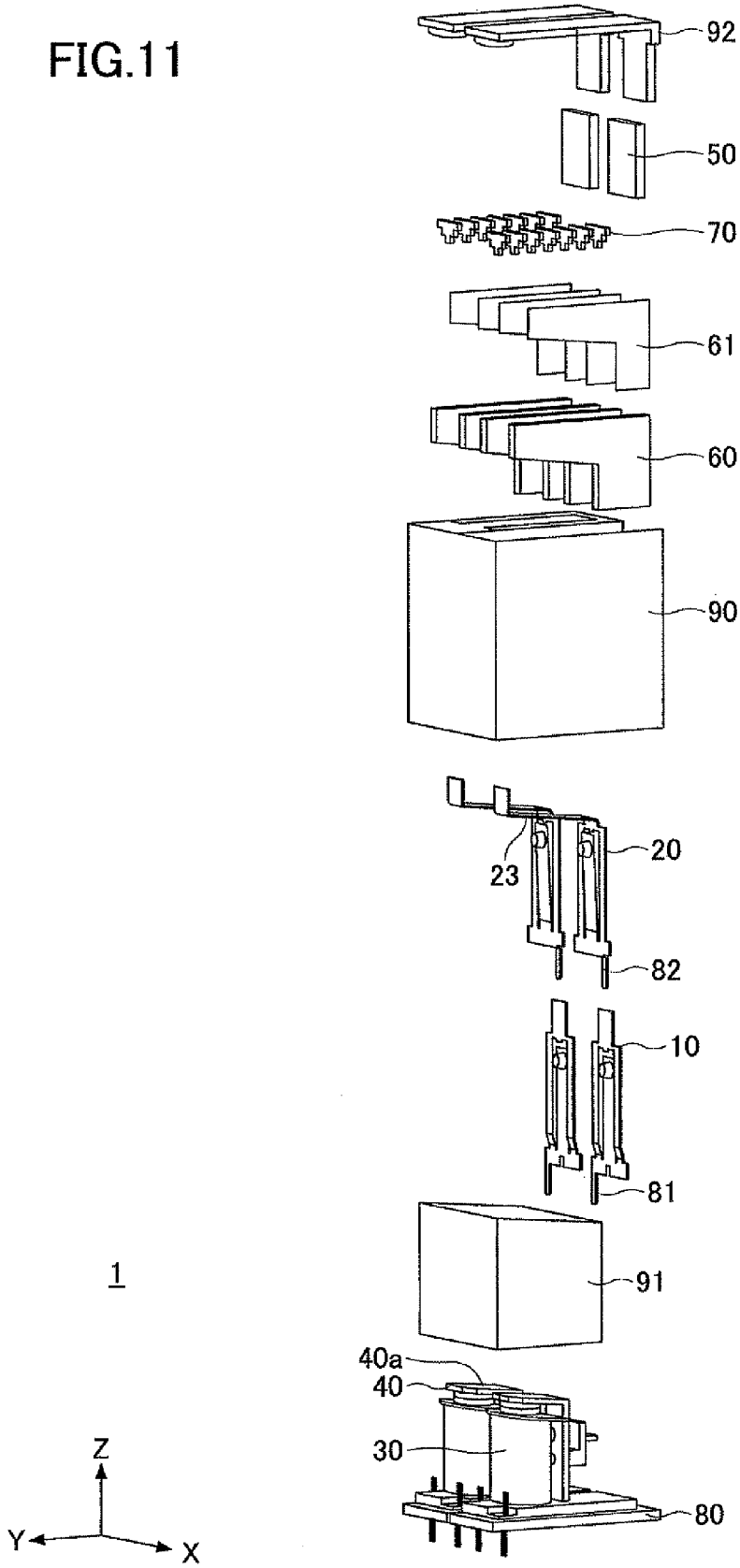
FIG. 11 schematically illustrates a method of manufacturing the electromagnetic relay of the embodiment.
Figure 12:
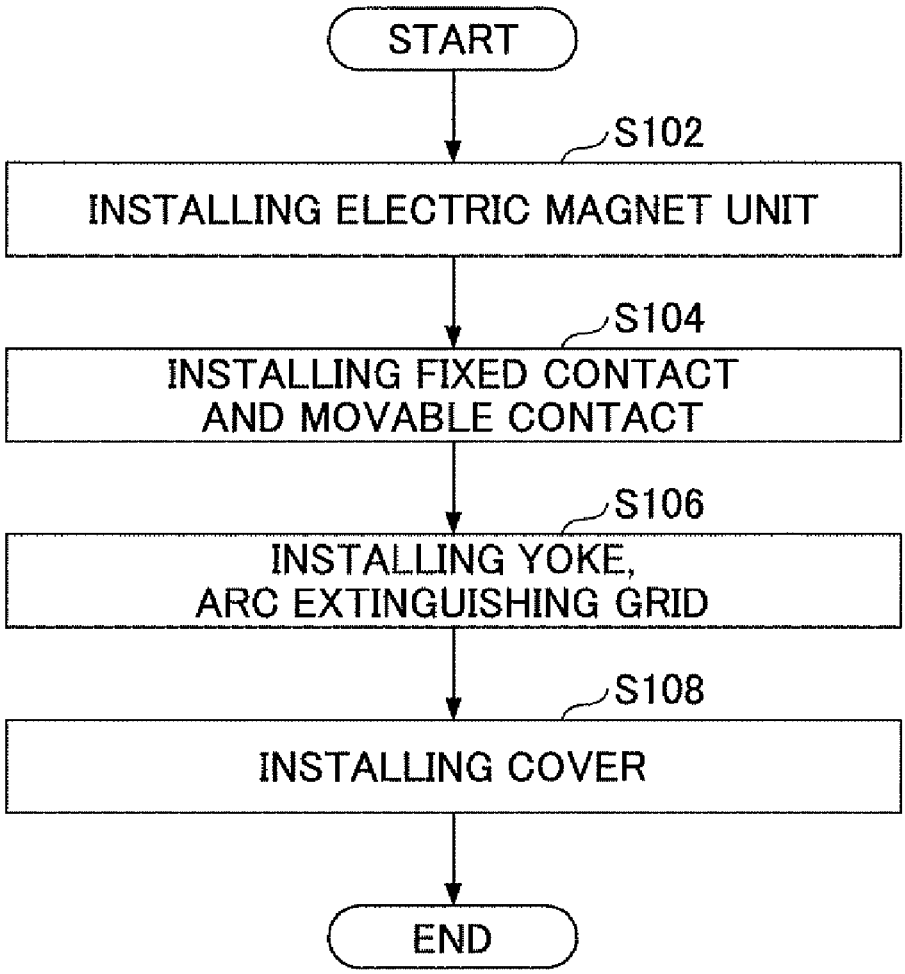
FIG. 12 is a flow chart of the method of manufacturing the electromagnetic relay of the embodiment.

Referring to FIG. 11 and FIG. 12, a manufacturing method of the electromagnetic relay 1 of the embodiment is described. The electromagnetic relay 1 of the embodiment can be formed by connecting members forming the electromagnetic relay 1 from one direction (parallel to the Z axis).

At first, the electric magnet unit 30 having the arming unit 40 connected to the base 80 of the electric magnet unit 30 is installed in step S102. The electric magnet unit 30 is installed so as to generate a magnetic field in the direction of Z axis. The arming unit 40 is installed so that the first arm 40*a* is positioned above the electric magnet unit 30.

Next, the fixed contact unit 10 and the movable contact unit 20 are installed in step S104. Specifically, the insulating case 91 having openings on both sides along the Z axis is connected to the base 80 in a direction parallel to the Z axis. Further, the fixed contact unit 10 and the movable contact unit 20 are connected to a portion of the base 80 in which the electric magnet unit 30 is not installed in a direction parallel to the Z axis so that the terminals 81 and 82 are positioned on the side of the base 80. At this time, the movable contact 20 is provided on the side in which the electric magnet unit 30 is installed and the movable contact 20 is connected to the base 80 so that the movable side arc runner 23 is positioned above the electric magnet unit 30 in an upper direction along the Z axis.

Next, the yoke 60, the insulating portion 61, the arc extinguishing grid 70 and the permanent magnet 50 are installed in step S106. Specifically, a lower opening of both the openings of the case 90 is connected to the base 80. At this time, the case 90 is connected to the base 80 in a direction parallel to the Z axis. Thereafter, the yoke 60, the insulating portion 61, the arc extinguishing grid 70, and the permanent magnet 50 are connected in a direction parallel to the Z axis.

Next, the cover 92 is installed in step S108. Specifically, the cover 92 is connected to the case 90 in the direction parallel to the Z axis so as to cover an upper opening of both the openings of the case 90. Thus, the electromagnetic relay 1 of the embodiment can be manufactured.

Since the components of the electromagnetic relay 1 illustrated in FIG. 11 are sequentially supplied to gradually form a lower structure to an upper structure, said differently the components can be supplied in one direction, the electromagnetic relay 1 having a high efficiency and a low cost can be manufactured. The base 80, the case 90, the insulating case 91, the cover 92 or the like are formed by an insulating resin material.

(Exhaust Port)

Figure 13:
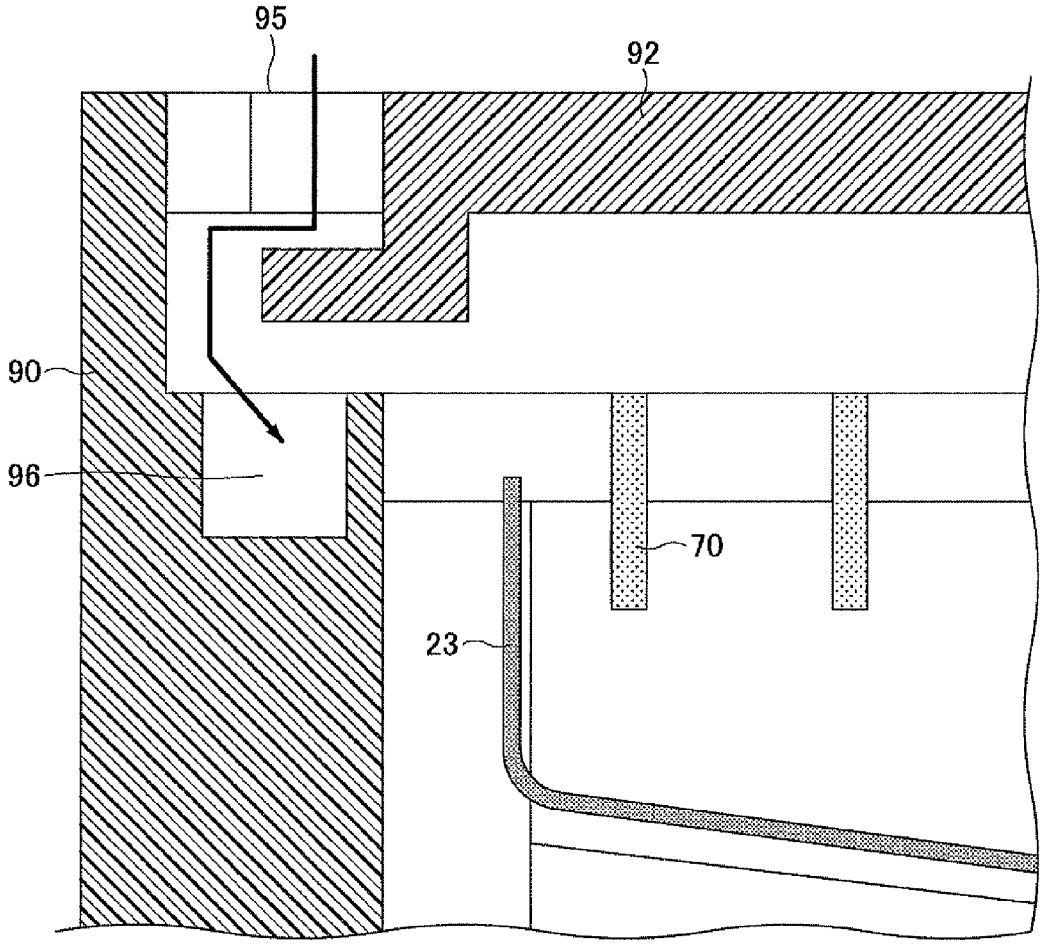
FIG. 13 is a flow chart of the electromagnetic relay of the embodiment.

The base 80, the case 90 and the cover 92 forms a casing of the electromagnetic relay 1 of the present invention. Referring to FIG. 13, when arcs are generated, it is possible to prevent the pressure inside the casing from increasing by exhausting a gas generated by the arcs from an exhaust port 95 formed between the case 90 and the cover 92.

The exhaust port 95 has plural bent portions to prevent dust or the like from intruding from the outside. By forming the bent portions, it is possible to prevent the dust or the like from intruding into the casing to a maximum extent. A dust catching portion 96 is provided in a portion of the exhaust port 95 to receive extraneous matters such as the dust intruding into the exhaust port 95 from the outside.

According to the present invention, it is possible to provide an electromagnetic relay 1 having a structure with which arcs are hardly attracted by the yokes for applying a magnetic field to the neighboring portions of the contacts in order to ensure high reliability and safety. Especially, it is possible to provide the electromagnetic relay for a voltage higher than that of the commercial power supply, the direct power source and so on with high reliability and safety.

Further, the present invention provides the electromagnetic relay having high reliability and safety and the manufacturing method of the electromagnetic relay. Especially, it is possible to provide the manufacturing method of the electromagnetic relay for a voltage higher than that of the commercial power supply, the direct power source and so on with high reliability and safety.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. An electromagnetic relay comprising:

a fixed contact unit that includes:

a fixed contact, and a fixed side arc runner connected to the fixed contact;

a movable contact unit that includes:

a movable side frame that extends in a longitudinal direction of the fixed side arc runner, a movable contact spring in which one end is connected to one end of the movable side frame, a movable contact provided in another end of the movable contact spring, and a movable side arc runner connected to another end of the movable side frame, the movable side arc runner being bent and extending from the movable side frame at an angle less than a right angle;

an electric magnet causing the movable contact to contact the fixed contact by applying force to the movable contact spring via an arming unit;

a magnet generating a magnetic field between the fixed contact and the movable contact; and a pair of yokes each made of a magnetic material, arranged in parallel to interpose the fixed contact and the movable contact therebetween and to apply the magnetic field generated by the magnet to an area where the fixed contact and the movable contact exist, respectively;

a pair of insulating portions provided on inner surfaces of the pair of yokes facing the fixed contact and the movable contact, respectively; and an arc extinguishing grid for extinguishing arcs, being provided on and between the inner surfaces of the pair of yokes along the movable side are runner.

2. The electromagnetic relay according to claim 1, wherein the insulating portions are shaped like a plate or coated on the yokes.

3. The electromagnetic relay according to claim 1, wherein the fixed side arc runner, the movable side arc runner, and the arc extinguishing grid exist in a space interposed between the pair of insulating portions.

4. The electromagnetic relay according to claim 1, wherein the fixed contact and the movable contact are positioned between the electric magnet and the magnet.

5. The electromagnetic relay according to claim 1, wherein when the movable contact contacts the fixed contact, an electric current flows in a direction from the fixed contact to the movable contact.

6. The electromagnetic relay according to claim 5, wherein a direction of separating contacting between the fixed contact and the movable contact, a direction of the magnetic field applied by the yokes, and the longitudinal direction of the fixed side arc runner are mutually perpendicular.

7. The electromagnetic relay according to claim 1, further comprising:

a fixed side tab protrudes from the fixed side arc runner toward the fixed contact, and a movable side tab protrudes from the movable side arc runner toward the movable contact.

8. The electromagnetic relay according to claim 7, wherein one or more selected from fixed side connecting portion, the movable side connecting portion, the fixed side tab, and the movable side tab are thicker than a rest which are not selected.

9. The electromagnetic relay according to claim 1, wherein the fixed contact and the fixed side arc runner are formed by processing a single metal plate, and the movable side frame, the movable contact spring and the movable side arc runner are formed by processing a single metal plate.

10. The electromagnetic relay according to claim 1, wherein the fixed contact unit further includes:

a fixed side frame which extends in the longitudinal direction, and a fixed contact plate in which one end is connected to one end of the fixed side frame, wherein the fixed contact is provided at the other end of the fixed contact plate, and the fixed side arc runner is provided at another end of the fixed contact frame, and extends in a longitudinal direction of the fixed contact frame.

* * * * *